US011480905B2

(12) United States Patent
Kawasaki et al.

(10) Patent No.: US 11,480,905 B2
(45) Date of Patent: Oct. 25, 2022

(54) IMAGE FORMING APPARATUS

(71) Applicant: Konica Minolta, Inc., Tokyo (JP)

(72) Inventors: Tomohiro Kawasaki, Sagamihara (JP); Hiroyuki Saito, Tokyo (JP); Kazutoshi Kobayashi, Toyokawa (JP); Keiki Katsumata, Hachioji (JP); Kei Okamura, Yokohama (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 17/319,009

(22) Filed: May 12, 2021

(65) Prior Publication Data

US 2021/0364967 A1 Nov. 25, 2021

(30) Foreign Application Priority Data

May 25, 2020 (JP) ..... JP2020-090178

(51) Int. Cl.
*G03G 15/00* (2006.01)

(52) U.S. Cl.
CPC ..... *G03G 15/5037* (2013.01)

(58) Field of Classification Search
CPC ..... G03G 15/5033; G03G 15/5037; G03G 15/5041; G03G 2215/00029; G03G 2215/00033; G03G 2215/00037
See application file for complete search history.

(56) References Cited

U.S. PATENT DOCUMENTS 6,389,253 B1 * 5/2002 Nonomura ..... G03G 15/0812 399/149
2007/0217802 A1 * 9/2007 Watanabe ..... G03G 15/09 399/55
2009/0016750 A1 * 1/2009 Kobayashi ..... G03G 15/0803 399/49
2010/0142983 A1 * 6/2010 Ozaki ..... G03G 15/5062 399/49
2013/0223861 A1 * 8/2013 Kubo ..... G03G 15/0849 399/53
2019/0049872 A1 * 2/2019 Mori ..... G03G 15/0855
2021/0041802 A1 * 2/2021 Shimizu ..... G03G 15/0907

FOREIGN PATENT DOCUMENTS

JP 2016-133552 A 7/2016

* cited by examiner

*Primary Examiner* — Carla J Therrien
(74) *Attorney, Agent, or Firm* — Squire Patton Boggs (US) LLP

(57) ABSTRACT

An image forming apparatus includes: an image carrier; an exposing device; a developing device with a developing roller; a development current detector that detects development current between the image carrier and the developing roller; and a hardware processor. Under an image forming condition, the hardware processor causes the exposing device to draw, on the image carrier, a development current-detection pattern that includes a solid image and a halftone image that follows the solid image in an image-conveying direction of the image carrier, causes the developing device to develop the development current-detection pattern, obtains information on a chronological change of the detected development current from the development current detector, and determines whether or not a ghost image due to the solid image occurs based on a temporary drop of the detected development current during development of the halftone image.

5 Claims, 8 Drawing Sheets

IMAGE FORMING APPARATUS

CROSS-REFERENCE TO RELATED APPLICATIONS

The entire disclosure of Japanese Patent Application No. 2020-090178 filed on May 25, 2020 is incorporated herein by reference in its entirety.

BACKGROUND

Technological Field

The present disclosure relates to an image forming apparatus.

Description of Related Art

Developing devices that develop images with two-component developer containing toner and carrier are widely used in electrophotographic image forming apparatuses, such as a copier, a printer, and a facsimile. In recent years, multistage developing devices that supply toner to an image carrier using multiple developing rollers have been developed. Such a developing device passes on developer from one developing roller to another to develop latent images on an image carrier multiple times, so that a high-quality image can be formed (for example, disclosed in JP2016-133552A).

SUMMARY

When an image forming apparatus with the above developing device forms, for example, a solid image, the first developing roller may consume much toner in its developing area, and the second and subsequent developing rollers may receive developer with a low toner density in their developing areas. This may result in ghost images that have a lower toner density than the other parts.

A ghost image may also be generated by a single developing roller. Such a ghost image occurs on a cycle of the developing roller (outer circumference/development θ) after developing a preceding image and has the pattern of the preceding image. The mechanism of a ghost image by a single developing roller is different from that by multiple developing rollers described above. When the surface of a sleeve constituting a single developing roller is partially stained with toner, the stained part and not-stained part have different development potentials, which result in different toner densities. Normally, the surface of a developing roller may be uniformly stained with toner. When the developing roller that is uniformly stained with toner develops an image pattern, part of the developing roller corresponding to the image pattern is cleared of toner stains and therefore has a low electric potential. The other part of the developing roller, on the other hand, is not cleared of toner stains. These cleared and uncleared parts have different potentials, which result in different densities.

The present invention has been conceived in view of the above issues. Objects of the present invention include easily identifying ghost images and reducing ghost images by changing image forming conditions.

To achieve at least one of the abovementioned objects, according to an aspect of the present invention, there is provided an image forming apparatus including: an image carrier; an exposing device that draws an electrostatic latent image on the image carrier; a developing device that supplies, using a developing roller facing the image carrier, a developer to the electrostatic latent image formed on the image carrier to form a toner image; a development current detector that detects development current that flows between the image carrier and the developing roller; and a hardware processor that controls the image carrier, the exposing device, the developing device, and the development current detector; wherein under a predetermined image forming condition, the hardware processor causes the exposing device to draw a development current-detection pattern on the image carrier, the development current-detection pattern including a solid image and a halftone image that follows the solid image in an image-conveying direction of the image carrier, causes the developing device to develop the development current-detection pattern, obtains, from the development current detector, information on a chronological change of the detected development current, and determines whether or not a ghost image due to the solid image occurs based on a temporary drop of the detected development current during development of the halftone image

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention, wherein.

DESCRIPTION OF EMBODIMENTS

Hereinafter, an embodiment of the present invention will be described with reference to the drawings. However, the scope of the invention is not limited to the disclosed embodiment.

[Configuration of Image Forming Apparatus]

Figure 1:
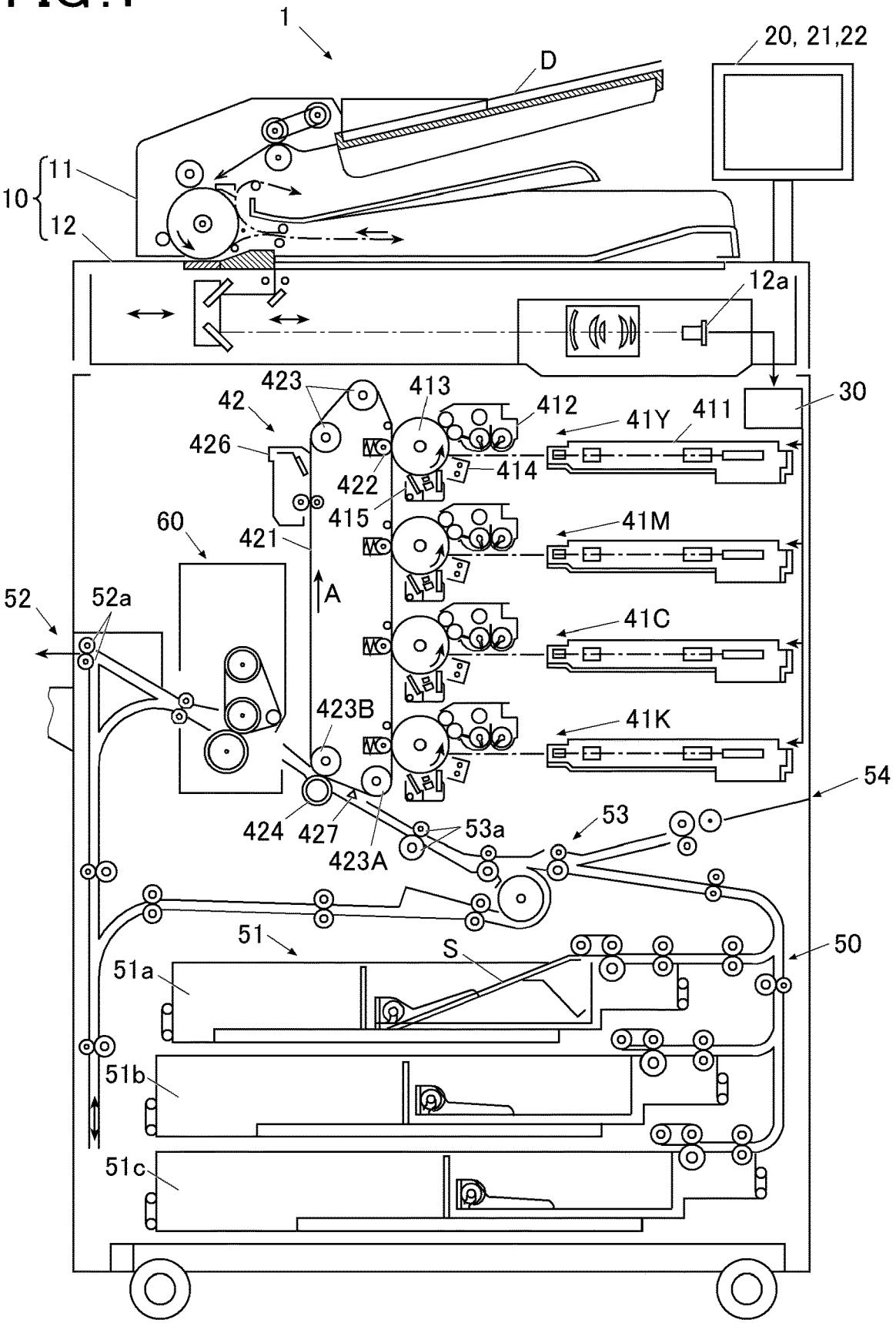
FIG. 1 is a schematic configuration of an entire image forming apparatus.
Figure 2:
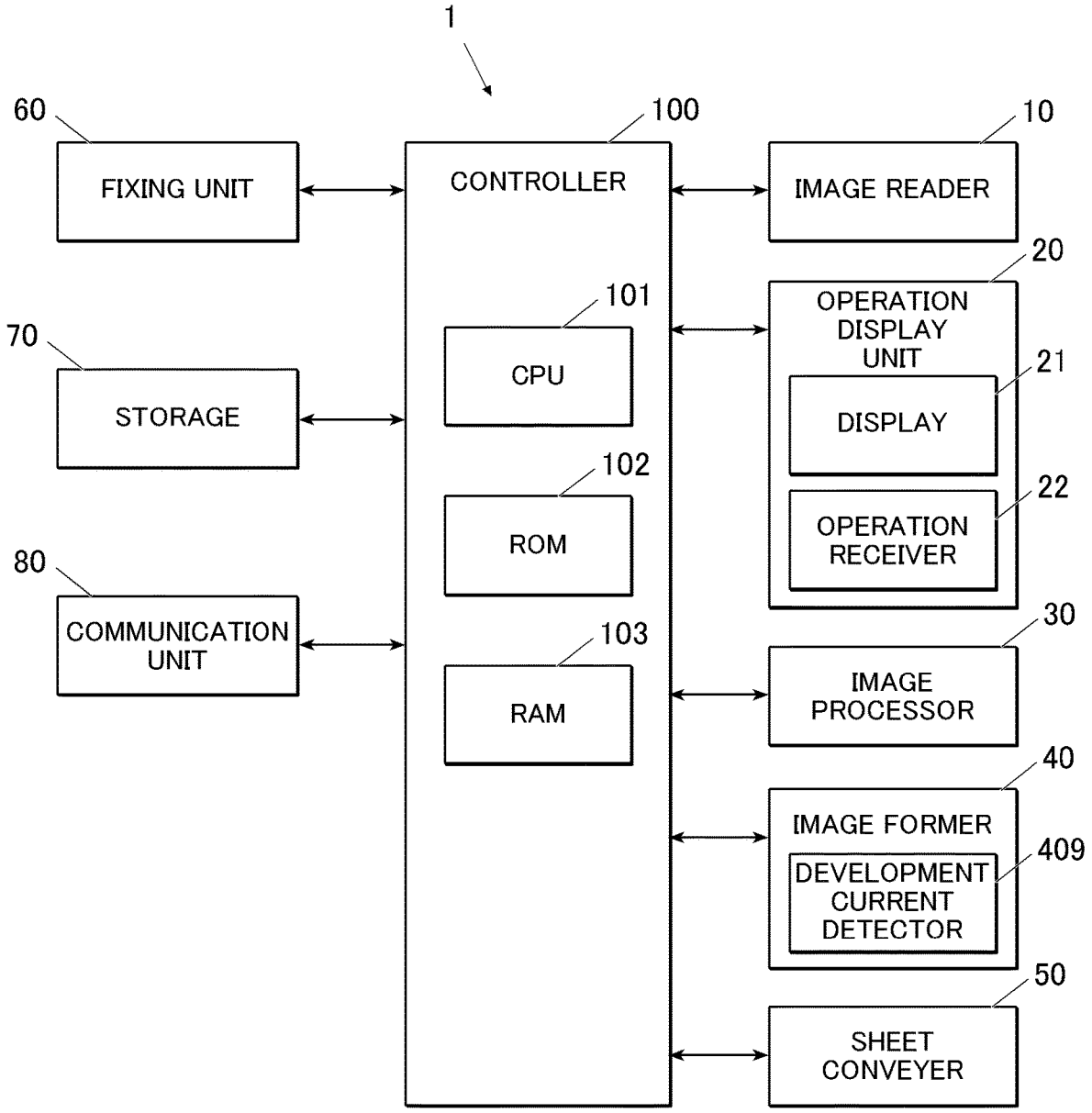
FIG. 2 is a block diagram showing functional components of the image forming apparatus.

FIG. 1 shows a schematic configuration of an image forming apparatus 1 in this embodiment. FIG. 2 is a block diagram showing main functional components of the image forming apparatus 1 in this embodiment.

The image forming apparatus 1 shown in FIGS. 1, 2 is an electrophotographic color image forming apparatus using the intermediate transfer system. In the image forming apparatus 1, toner images formed with colors of Y (yellow), M (magenta), C (cyan), and K (black) on photoconductive drums 413 are transferred onto an intermediate transfer belt 421 (first transfer) so as to be superposed on one another, and the YMCK toner image is transferred onto a sheet of paper (second transfer). Thus, an image is formed.

The image forming apparatus 1 employs a tandem system in which the photoconductive drums 413 for YMCK four colors are arranged in series in the moving direction of the intermediate transfer belt 421 to sequentially transfer toner images of the respective colors onto the intermediate transfer belt 421.

As shown in FIG. 2, the image forming apparatus 1 includes an image reader 10, an operation display unit 20, an image processor 30, an image former 40, a sheet conveyer 50, a fixing unit 60, a storage 70, a communication unit 80, and a controller 100 (hardware processor, controlling unit, obtaining unit, switching unit).

The controller 100 includes a central processing unit (CPU) 101, a read only memory (ROM) 102, and a random access memory (RAM) 103. The CPU 101 reads a program corresponding to processing contents from the ROM 102, loads it in the RAM 103, and centrally controls operation of the components of the image forming apparatus 1 shown in FIG. 2 in cooperation with the loaded program.

The image reader 10 includes an auto document feeder (ADF) 11 and a document image scanner (scanner) 12.

The ADF 11 conveys, with a conveying mechanism, a document D placed on a document tray to the scanner 12. The ADF 11 allows the scanner 12 to continuously and ceaselessly read images on (both sides of) a large number of documents D placed on the document tray.

The scanner 12 optically scans each document conveyed onto a platen glass by the ADF 11 or document placed on the platen glass, and forms, on a light receiving face of a charge coupled device (CCD) sensor 12*a*, an image of the reflected light from the document, thereby reading the image on the document. The image reader 10 generates input image data on the basis of the reading result by the scanner 12. The input image data is subjected to predetermined image processing by the image processor 30.

The operation display unit 20 consists of a liquid crystal display (LCD) with a touchscreen, for example and functions as a display 21 and an operation receiver 22. The display 21 displays various operation windows, image conditions, and operation statuses of the functional components in accordance with display control signals input by the controller 100. The operation receiver 22 includes various operation keys, such as a numeric keypad and a start key, receives various input operations made by a user, and outputs operation signals to the controller 100.

The image processor 30 includes a circuit that performs digital image processing on image data of an input job (input image data) in accordance with initial settings or user settings. For example, the image processor 30 performs gradation correction on the basis of gradation correction data (gradation correction table) under the control of the controller 100. As well as gradation correction, the image processor 30 performs various kinds of correction, such as color correction and shading correction, and compression processing on the input image data. The image former 40 is controlled on the basis of the image data on which these kinds of processing have been performed.

The image former 40 includes: image forming units 41Y, 41M, 41C, and 41K for forming images with toner of the respective Y, M, C, K color components on the basis of the input image data on which the image processing has been performed; and an intermediate transfer unit 42.

The image forming units 41Y, 41M, 41C, and 41K for Y, M, C, K color components have the same configuration. For convenience of illustration and description, the parts common to the image forming units 41Y, 41C, 41M, and 41K are denoted by the same reference numerals. In order to distinguish each of the common parts, "Y", "M", "C", or "K" is added to the corresponding reference numeral. In FIG. 1, only the parts of the image forming unit 41Y for the Y color component have reference numerals, and the reference numerals of the parts of the other image forming units 41M, 41C, and 41K are omitted.

Each image forming unit 41 includes an exposing device 411, a developing device 412, a photoconductive drum 413 (image carrier), a charging device 414, and a drum cleaner 415.

The photoconductive drum 413 consists of, for example, a negatively chargeable organic photoconductor (OPC) in which an under coat layer (UCL), a charge generation layer (CGL), and a charge transport layer (CTL) are laminated in order on the peripheral surface of an electroconductive cylindrical aluminum body (aluminum tube). The CGL consists of an organic semiconductor made of a resin binder (e.g. polycarbonate resin) and a charge generation material (e.g. phthalocyanine pigment) dispersed in the resin binder. The CGL generates pairs of positive charges and negative charges when exposed by the exposing device 411. The CTL consists of a resin binder (e.g. polycarbonate resin) and a hole transport material (electron-donating nitrogen-containing compounds) dispersed in the resin binder. The CTL transfers the positive charges generated at the CGL to the surface of the CTL.

The controller 100 causes the photoconductive drums 413 to rotate at a constant peripheral speed (e.g., 665 mm/second) by regulating driving signals sent to a not-shown driving motor(s) that rotates the photoconductive drums 413.

The charger 414 negatively and uniformly charges the surface of the photoconductive drum 413. The exposing device 411 consists of a semiconductor laser, for example and emits laser light corresponding to images of its color component onto the photoconductive drum 413. The positive charges generated at the CGL of the photoconductive drum 413 by the exposure are transferred to the surface of the CTL and neutralize the negative charges on the surface of the photoconductive drum 413. Accordingly, an electrostatic latent image(s) of the corresponding color component is formed on the surface of the photoconductive drum 413 by the electric potential difference between the exposed and non-exposed regions.

The developing device 412 uses a two-component developer that contains toner and carrier. The developing device 412 causes toner of its color component to adhere to the surface of the photoconductive drum 413 to visualize the electrostatic latent image. Thus, the developing device 412 forms a toner image.

Figure 3:
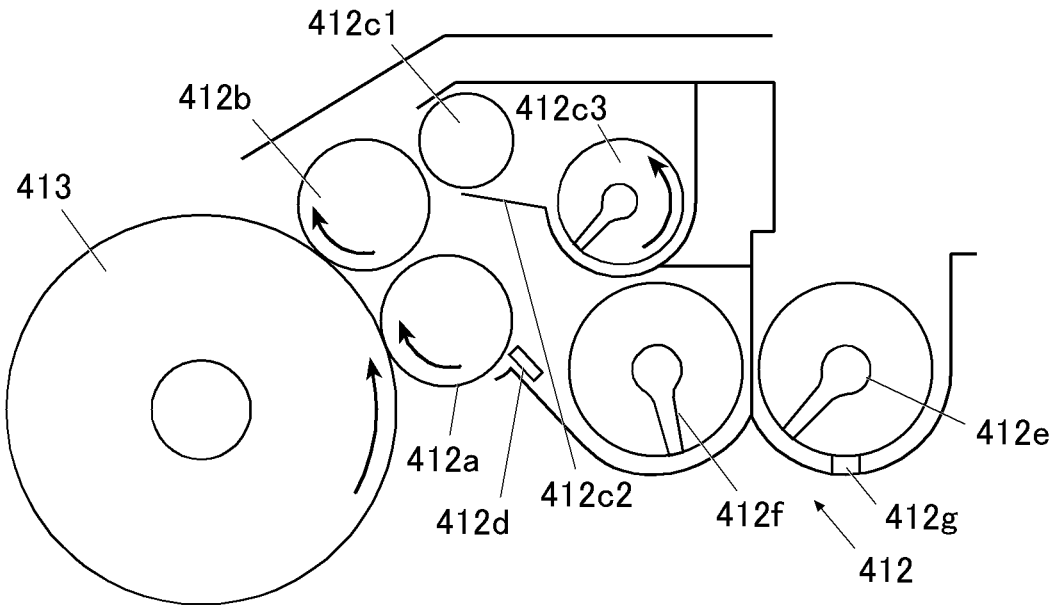
FIG. 3 is a schematic configuration of a developing device.

Detailed configuration of the developing device 412 is described with reference to FIGS. 3, 4.

The developing device 412 forms a toner image on the surface of the photoconductive drum 413 by causing toner of the corresponding color component to adhere to the surface of the photoconductive drum 413. As shown in FIG. 3, the developing device 412 includes a first developing roller 412*a*, a second developing roller 412*b*, a collecting roller 412*c*1, a regulating blade 412*d*, a stirring roller 412*e*, a conveying roller 412*f*, and a sensor 412*g*.

The first developing roller 412*a* and the second developing roller 412*b* each include a rotatable developing sleeve and a developing magnet roll provided inside the developing sleeve. The first developing roller 412*a* and the second developing roller 412*b* are placed close to the photoconductive drum 413 and deliver the developer to their respective developing areas close to the photoconductive drum 413. More specifically, the first developing roller 412*a* and the second developing roller 412*b* rotate in the same direction, and the upstream first developing roller 412*a* delivers the developer to the downstream second developing roller 412*b* to convey the developer to their respective developing areas. The developing sleeves rotate clockwise in the figures. The developing magnet roll houses multiple magnetic poles that generate a magnetic field.

The collecting roller 412*c*1 for collecting excess developer is placed close to the second developing roller 412*b*. The toner collected by the collecting roller 412*c*1 is conveyed to the stir-and-convey member 412*c*3 via the guide member 412*c*2, and then conveyed by the stir-and convey member 412*c*3 to a store room of the stirring roller 412*e* or the conveying roller 412*f*.

The stirring roller 412*e* and the conveying roller 412*f* are spiral-shaped screw members. The stirring roller 412*e* rotates to stir and mix the toner and carrier, so that the toner and carrier are charged by friction. The developer charged by friction is conveyed from the stirring roller 412*e* to the conveying roller 412*f*. The conveying roller 412*f* rotates to convey the charged developer to the developing roller 412*a*. The sensor 412*g* is placed close to the stirring roller 412*e* to detect the toner density. On the basis of the detection result by the sensor 412*g*, a not-shown supplying unit supplies developer according to the amount of the consumed toner.

When the developer arrives at the first developing roller 412*a*, the developer forms magnetic brushes on the outer circumferential surface of the developing sleeve owing to the magnetic field generated by the developing magnet roll of the first developing roller 412*a*. Accordingly, layers of developer are formed on the outer circumferential surface of the developing sleeve. The developing sleeve rotates clockwise shown in the figures while holding the developer on its outer circumferential surface with the magnetic field to convey the developer to the developing area, where the developing sleeve is closest to the photoconductive drum 413. At the time, the regulating blade 412*d* regulates the thickness of the layers of developer, so that a constant amount of developer is conveyed to the developing area. In the developing area, the toner is electrostatically moved to the electrostatic latent image formed on the photoconductive drum 413 from the developing sleeve of the first developing roller 412*a*. On the other hand, part of the developer of the developing sleeve on the first developing roller 412*a* is passed on to the second developing roller 412*b* by the force of the magnetic field. As with the first developing roller 412*a*, the second developing roller 412*b* forms layers of developer on the developing sleeve, and the developer is moved to the photoconductive drum 413 in the developing area.

The developing device 412 thus supplies toner to the photoconductive drum 413 to make the electrostatic latent image visible with toner. The developing device 412, which includes the first developing roller 412*a* and the second developing roller 412*b*, can secure developing areas to form high-quality images.

Figure 4:
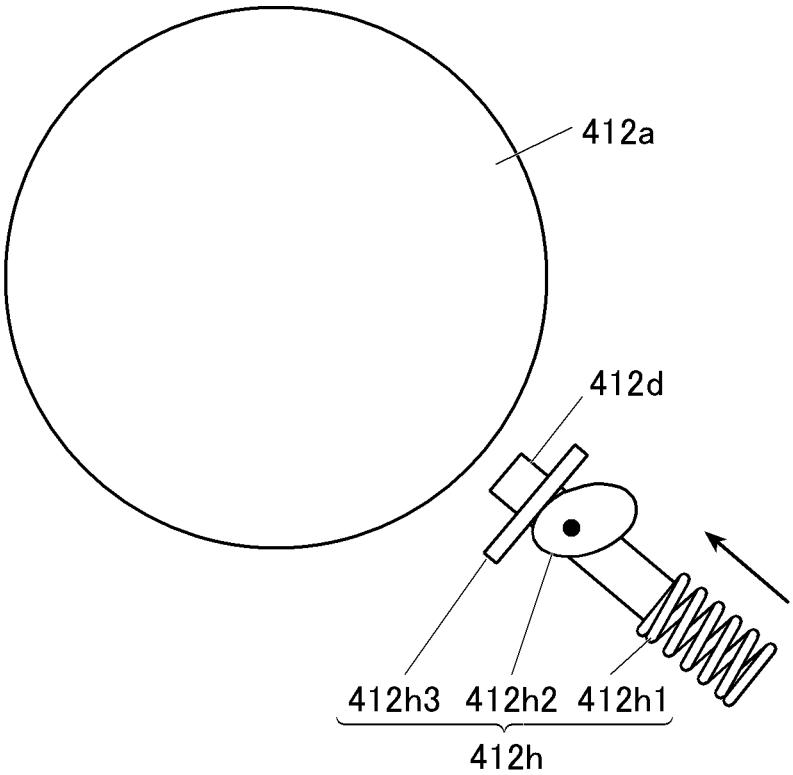
FIG. 4 is a figure to describe the configuration of the developing device.

The regulating blade 412*d* includes a movable part 412*h* to change the position of the regulating blade 412*d*, as shown in FIG. 4. By changing the position of the regulating blade 412*d*, the gap between the first developing roller 412*a* and the regulating blade 412*b* can be widened and narrowed. That is, the thickness of the layers of developer can be changed. Accordingly, the amount of the conveyed developer can be adjusted.

More specifically, the movable part 412*h* includes, for example, an elastic part 412*h*1 that supports the regulating blade 412*d*, a cam part 412*h*2 that is rotatable by a not-shown motor, an abutting plate 412*h*3 that is fixed to the regulating blade 412*d* and that contacts the cam part 412*h*2, as shown in FIG. 4. The position of the regulating blade 412*d* with respect to the photoconductive drum 413 is changed by moving the abutting plate 412*h*3 according to the rotation of the cam member 412*h*2.

The configuration of the movable part 412*h* is not limited to the above as long as the movable part 412*h* can change the position of the regulating blade 412*d* with respect to the photoconductive drum 413.

The type of carrier is not specifically limited. A well-known widely used carrier can be used, such as a binder carrier and a coated carrier. The diameter of a carrier particle is preferably 15 to 100 μm but is not limited thereto.

Similarly, the type of toner is not specifically limited. A well-known widely used toner can be used. For example, a binder resin that contains a colorant and as necessary a charge controlling agent and/or a separating agent and that is treated with an external additive can be used. The diameter of a toner particle is preferably around 3 to 15 μm but is not limited thereto.

The drum cleaner 415 has a drum cleaning blade or the like that slidingly contacts the surface of the photoconductive drum 413. The drum cleaner 415 removes the residual toner on the surface of the photoconductive drum 413 after the first transfer.

The intermediate transfer unit 42 includes an intermediate transfer belt 421, first transfer rollers 422 (transfer members), supporting rollers 423, a second transfer roller 424, a belt cleaner 426, and a sensor 427.

The intermediate transfer belt 421 consists of an endless belt and is stretched around the supporting rollers 423 to be a loop. At least one of the supporting rollers 423 is a driving roller, and the others are driven rollers. For example, the roller 423A, which is provided downstream from the first transfer roller 422 for the K-color component in the moving direction of the belt, is preferable as the driving roller. This makes it easy to keep the moving speed of the belt uniform at the first transfer points. Rotation of the driving roller 423A makes the intermediate transfer belt 421 move at a constant speed in the direction of the arrow A.

The first transfer rollers 422 are provided at the inner circumferential surface side of the intermediate transfer belt 421 so as to face their respective photoconductive drums 413. Each of the first transfer rollers 422 is pressed against the corresponding photoconductive drum 413 with the intermediate transfer belt 421 inbetween to form a first transfer nip part. At the first transfer nip part, a toner image is transferred from the photoconductive drum 413 to the intermediate transfer belt 421.

The second transfer roller 424 is provided on the outer circumferential surface side of the intermediate transfer belt 421 so as to face the roller 423B (hereinafter called backup roller 423B), which is provided downstream from the driving roller 423A in the belt moving direction. The second transfer roller 424 is pressed against the backup roller 423B with the intermediate transfer belt 421 inbetween to form a second transfer nip part. At the second transfer nip part, a YMCK toner image is transferred from the intermediate transfer belt 421 to a sheet of paper.

When the intermediate transfer belt 421 passes through the first transfer nip parts, the toner images formed on the surfaces of the photoconductive drums 413 are sequentially transferred onto the intermediate transfer belt 421 so as to be superposed on top of one another (first transfer). More specifically, a first transfer bias is applied to each first transfer roller 422, so that charges having reverse polarity to that of the toner are given to the inner surface side of the intermediate transfer belt 421 (the side abutting the first transfer rollers 422). Accordingly, the toner images are electrostatically transferred onto the intermediate transfer belt 421.

When the sheet passes through the second transfer nip part, the YMCK toner image on the intermediate transfer belt 421 is transferred onto the sheet (second transfer). More specifically, a second transfer bias is applied to the second transfer roller 424, so that charges having reverse polarity to that of the toner are given to the inner surface side of the sheet (the side abutting the second transfer roller 424). Accordingly, the toner image is electrostatically transferred onto the sheet. The sheet on which the toner image has been transferred is then conveyed to the fixing unit 60.

The belt cleaner 426 includes a belt cleaning blade 426 that slidingly contacts the surface of the intermediate transfer belt 421 and removes the toner remaining on the surface of the intermediate transfer belt 421 after the second transfer. Instead of the second transfer roller 424, a belt-type second transfer unit may be used. The belt-type second transfer unit has a second transfer belt stretched around supporting rollers including a second transfer roller to be a loop.

The sensor 427 is placed between the roller 423A and the roller 423B so as to face the surface of the intermediate transfer belt 421, for example. The sensor 427 detects the amount of toner adhering to the intermediate transfer belt 421. The sensor 427 is, for example, an optical reflection density sensor and is usable for controlling the image density.

The fixing unit 60 heats and pressurizes, at a fixing nip part, the conveyed sheet on which the toner image has been transferred by the second transfer to fix the toner image to the sheet.

The sheet conveyer 50 includes a sheet feeder 51, a sheet ejector 52, and a conveyance path unit 53. The sheet feeder 51 has three sheet feeding tray units 51*a*, 51*b*, and 51*c* that house sheets of paper (standardized paper and/or special paper) by predetermined type, the sheets being sorted according to the basis weight and/or the size. The conveyance path unit 53 has pairs of conveying rollers, such as a pair of register rollers 53*a*.

The sheets housed in the sheet feeding tray units 51*a* to 51*c* are sent out one by one from the top and conveyed to the image former 40 by the conveyance path unit 53. A register roller unit having the pair of register rollers 53*a* registers the fed sheet and adjusts timing of conveying the sheet. The image former 40 transfers the YMCK toner image on the intermediate transfer belt 421 onto one side of the sheet as the second transfer. The fixing unit 60 then performs fixing on the sheet. The sheet on which the image has been formed is ejected outside the apparatus by the sheet ejector 52 that has sheet ejecting rollers 52*a*.

The sheets may be a long paper or a rolled paper. The sheet of long paper/rolled paper is stored in a not-illustrated sheet feeding device connected to the image forming apparatus 1. The sheet is supplied to the image forming apparatus 1 from the sheet feeding device through the sheet feeding opening 54 and then sent out to the conveyance path unit 53.

The storage 70 consists of, for example, a nonvolatile semiconductor memory (flash memory) and/or a hard disc drive. The storage 70 stores various kinds of data including information on various settings of the image forming apparatus 1.

The communication unit 80 consists of a communication control card, such as a local area network (LAN) card, and exchanges data with external devices (e.g. personal computer) connected to communication networks, such as a LAN and a wide area network (WAN).

[Countermeasures to Ghost Images]

Next, a method to restrain occurrence of ghost images is described.

Ghost images to deal with include (i) ghost images caused by multiple developing rollers as described above and (ii) ghost images caused by a single developing roller.

Ghost images by multiple developing rollers can be generated by a developing device like the developing device 412 of the image forming apparatus 1, which has the upstream first developing roller 412*a* and the downstream second developing roller 412*b* along the direction in which an image on the photoconductive drum 413 (image carrier) is conveyed (image-conveying direction). More specifically, the developing device 412 adjusts the thickness of the layer of the developer on the upstream first developing roller 412*a* and delivers the adjusted developer to the downstream second developing roller 412*b*, so that the first developing roller 412*a* and the second developing roller 412*b* develop the latent image formed on the photoconductive drum 413 with a time lag.

A developing device having two or more developing rollers arranged from the upstream to the downstream can generate a ghost image.

When the upstream developing roller develops, for example, a solid image, low-density toner may be passed on to the downstream developing roller. Accordingly, part of the image developed by the downstream developing roller may have a lower toner density. The part having the lower toner density emerges as a ghost image. For a developing device having two developing rollers, the second developing roller may generate a ghost image originated from the first developing roller. For a developing device having three or more developing rollers, compound ghost images can occur. More specifically, the second developing roller may generate a ghost image originated from the first developing roller, and the third developing roller may generate ghost images originated from the first and second developing rollers, and the same is repeated thereafter.

Ghost images by a single developing roller can be generated by a developing device having only one developing roller or by a developing device having multiple developing rollers arranged from the upstream to the downstream. In the latter case, ghost images by a single developing roller are originated from each of the multiple developing rollers.

The image forming apparatus 1 includes a development current detector 409 that detects development current between the photoconductive drum 413 and the first and second developing rollers 412*a*, 412*b*.

Figure 5:
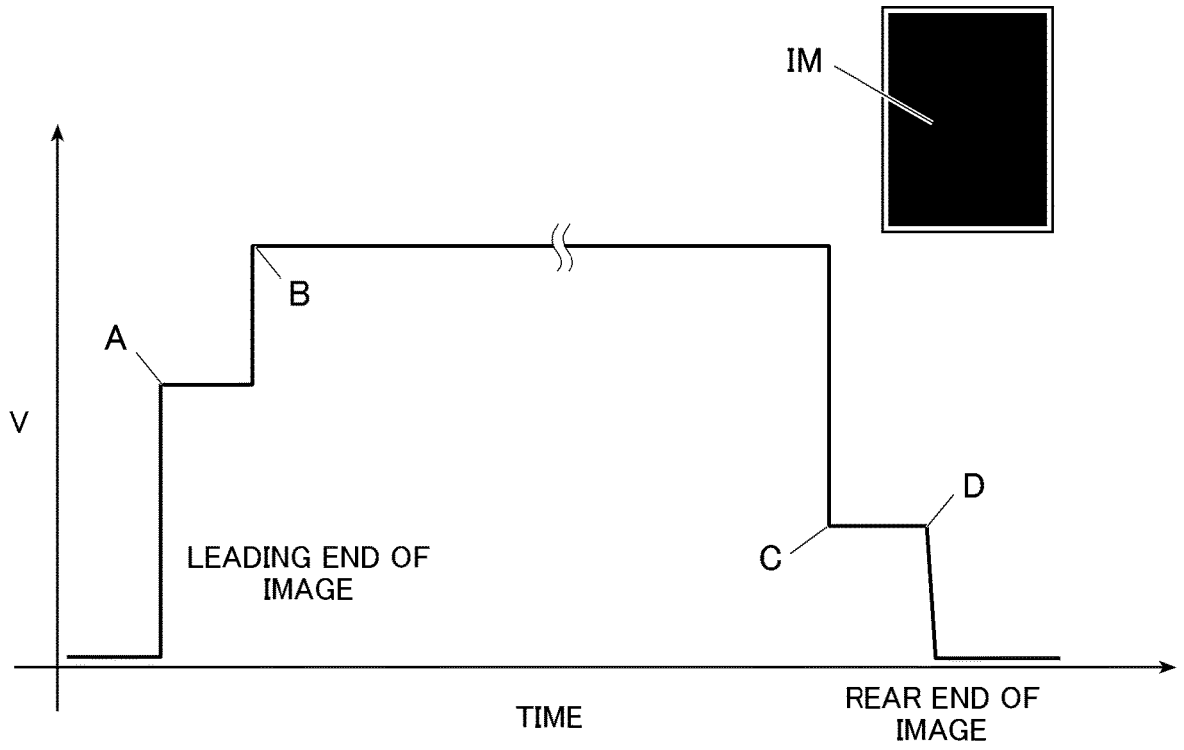
FIG. 5 shows a plan view of an example solid image and information on chronological changes of detected values of development current in developing the solid image (development current profile)

To facilitate understanding, assume that a solid image IM shown in FIG. 5 is formed. FIG. 5 shows a plan view of the solid image IM and information on chronological changes of the detected values of the development current obtained by the controller 100 from the development current detector 409. The information is hereinafter called a development current profile.

The controller 100 performs image forming operation in which the same development bias is applied to the upstream first developing roller 412*a* and the downstream second developing roller 412*b*.

At the point A (leading end of the image IM) of the development current profile in FIG. 5, the leading end of the latent image on the photoconductive drum 413 corresponding to the solid image IM reaches the position closest to the upstream first developing roller 412*a* (first developing position), and the upstream first developing roller 412*a* starts developing the latent image. The detected value of the development current therefore rises at the point A.

At the point B of the development current profile in FIG. 5, the leading end of the latent image on the photoconductive drum 413 corresponding to the solid image IM reaches the position closest to the downstream second developing roller 412*b* (second developing position), and the downstream second developing roller 412*b* starts developing the latent image, as well as the upstream first developing roller 412*a*. The detected value of the development current at the point B is therefore higher than at the point A.

At the point C of the development current profile in FIG. 5, the rear end of the latent image on the photoconductive drum 413 corresponding to the solid image IM passes through the first developing position. After the point C, only the downstream second developing roller 412*b* performs the development. The detected value of the development current at the point C is therefore lower than at the point B.

At the point D (rear end of the image IM) of the development current profile in FIG. 5, the downstream second developing roller 412*b* finishes developing the latent image.

The time between the points A and B and the time between the points C and D are determined by (i) the angle formed by the first developing position of the first developing roller 412*a* and the second developing position of the second developing roller 412*b* with respect to the center of the photoconductive drum 413 and (ii) the linear velocity of the photoconductive drum 413.

Next, a development current-detection pattern CT for detecting ghost images is described.

Figure 6:
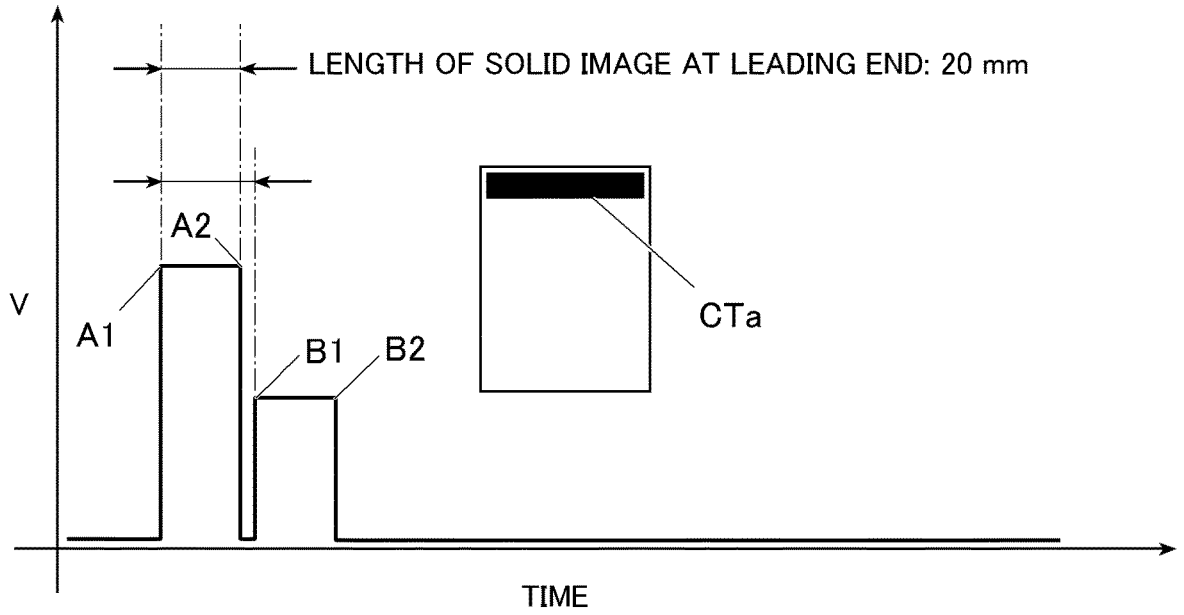
FIG. 6 shows a plan view of only a solid image at a leading end and a development current profile in developing the solid image.
Figure 7:
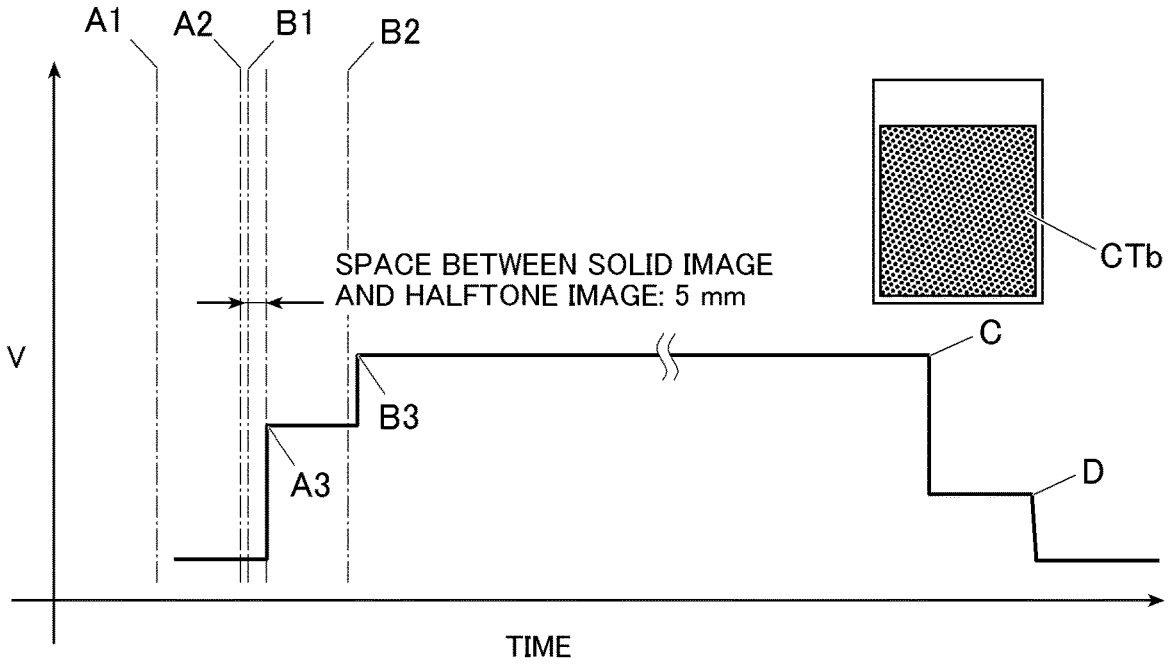
FIG. 7 shows a plan view of only a halftone image and a development current profile in developing the halftone image.
Figure 8:
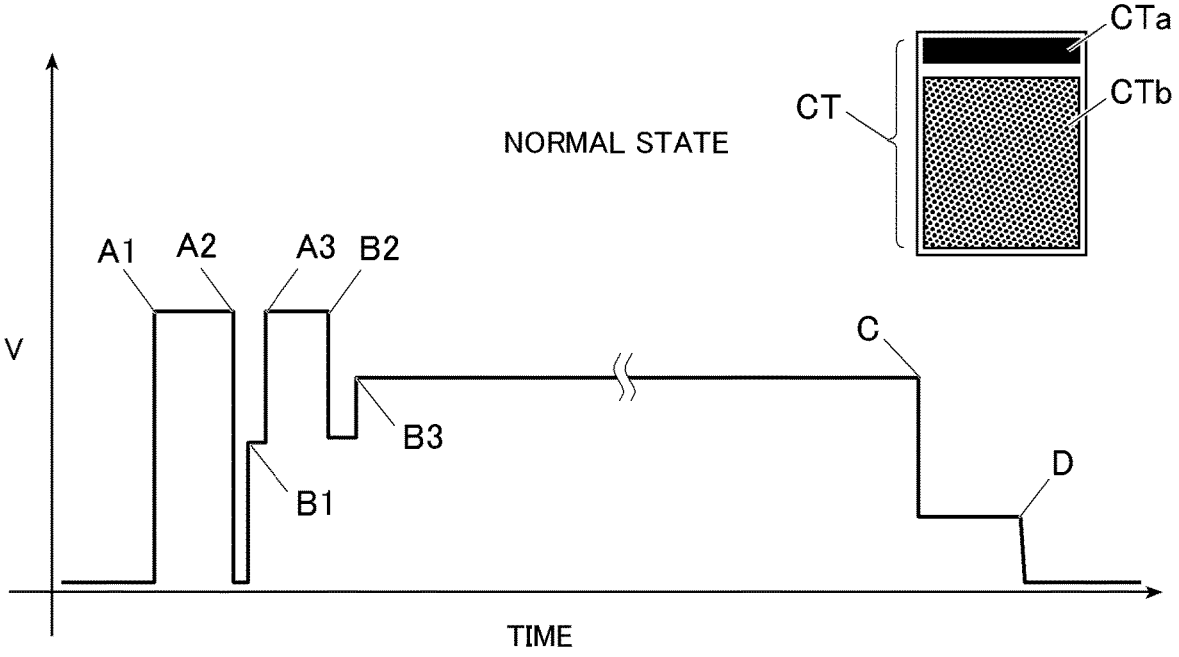
FIG. 8 shows a plan view of a development current-detection pattern and a development current profile in developing the pattern when a ghost image does not occur.
Figure 9:
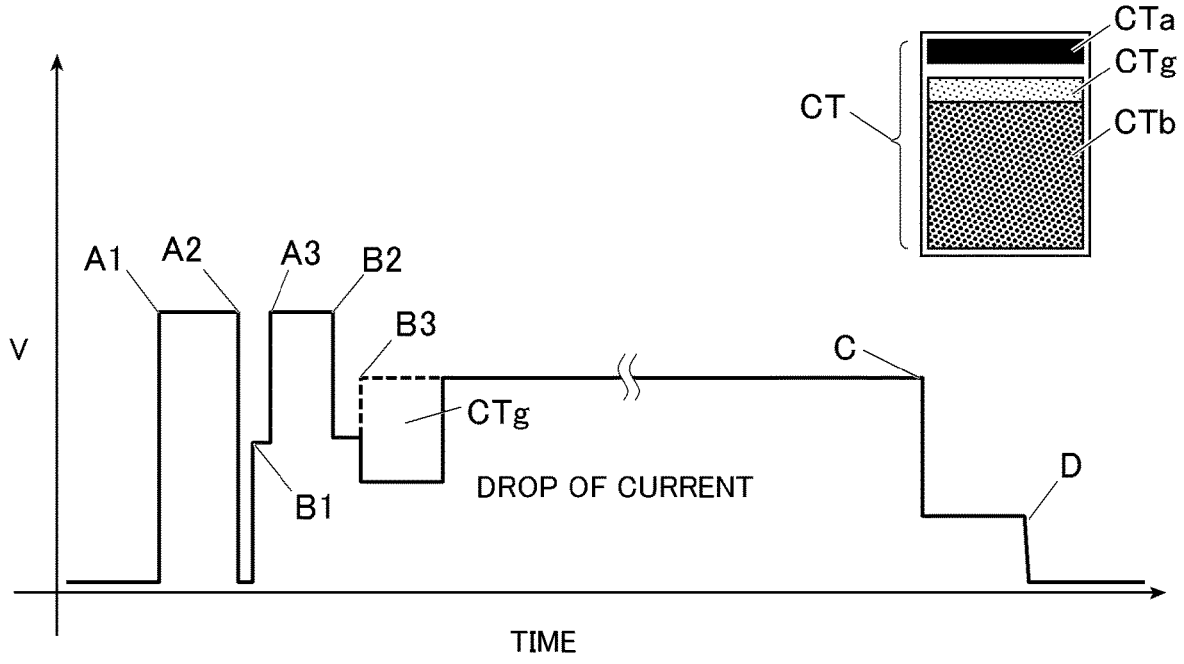
FIG. 9 shows the development current-detection pattern and a development current profile in developing the pattern when a ghost image occurs.

The development current-detection pattern CT is constituted of, along the image conveying direction of the photoconductive drum 413, (i) a 20 mm-long solid image CTa, (ii) a 5 mm-long blank space that follows the solid image CTa, and (iii) a halftone image CTb that follows the blank space. FIG. 6 shows a plan view of only the solid image CTa and the development current profile in developing the solid image CTa. FIG. 7 is a plan view of only the halftone image CTb and the development current profile in developing the halftone image CTb. FIG. 8 shows a plan view of the development current-detection pattern CT and the development current profile in developing the development current-detection pattern CT. In FIG. 8, a ghost image does not occur. FIG. 9 shows a plan view of the development current-detection pattern CT and the development current profile in developing the development current-detection pattern CT. In FIG. 9, a ghost image occurs.

In FIGS. 6 to 8, the point A1 indicates that the leading end of the latent image corresponding to the solid image CTa reaches the first developing position at which the photoconductive drum 413 is closest to the first developing roller 412*a*, and the point A2 indicates that the rear end of the latent image corresponding to the solid image CTa reaches the first developing position, and the point A3 indicates that the leading end of the halftone image CTb reaches the first developing position. Further, the point B1 indicates that the leading end of the solid image CTa reaches the second developing position at which the photoconductive drum 413 is closest to the second developing roller 412*b*, and the point B2 indicates that the rear end of the solid image CTa reaches the second developing position, and the point B3 indicates that the leading end of the halftone image CTb reaches the second developing position.

As shown in FIG. 6, the distance for which the photoconductive drum 413 conveys the latent image between the points A1 (when the leading end of the solid image CTa reaches the first developing position) and B1 (when the leading end of the solid image CTa reaches the second developing position) is set to be longer than 20 mm, which is the length of the solid image CTa in the latent-image conveying direction (A1 to A2, B1 to B2). More specifically, the distance for which the photoconductive drum 413 conveys the latent image between the points A1 and B1 is 22.7 mm.

Accordingly, the time period during which the first developing roller 412*a* develops the solid image CTa does not overlap the time period during which the second developing roller 412*b* develops the solid image CTa. These two time periods are separate.

Further, as shown in FIG. 7, the point A2 at which the rear end of the solid image CTa reaches the first developing position, the point B1 at which the leading end of the solid image CTa reaches the second developing position, and the point A3 at which the leading end of the halftone image CTb reaches the first developing position are in chronological order.

FIG. 8 shows the development current profile in developing the development current-detection pattern CT, which is constituted of the solid image CTa and the halftone image CTb.

FIG. 9 shows a case where a negative ghost CTg occurs. The negative ghost CTg corresponds to a ghost image of the solid image CTa. According to the development current profile in FIG. 9, an approximately 20 mm-long negative ghost CTg occurs immediately after the point B3. In the development current profile in FIG. 9, the negative ghost CTg appears as a partial drop of the development current during the development of the halftone image CTb.

Figure 10:
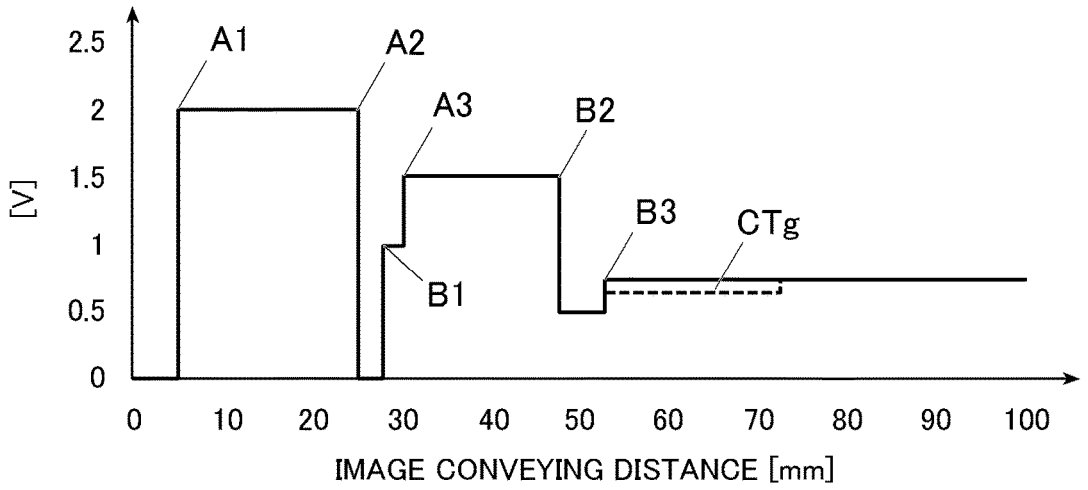
FIG. 10 is a development current profile when the horizontal axis of the development current profile in FIG. 9 is changed to the image conveying distance.

In FIG. 10, the horizontal axis of the development current profile indicates the image-conveying distance instead of the time in FIG. 9. The level of development current values corresponds to the image density. During the development of the halftone image CTb, the part corresponding to the negative ghost CTg is shown as having a conspicuously low image density. When the development θ is increased, the position where the negative ghost CTg occurs shifts to the leading-end side, which can restrain locally low image density. The development θ is a ratio of the linear velocity of the developing roller(s) to the linear velocity of the image carrier (photoconductive drum 413).

The negative ghost CTg is the former type of ghost image among (i) ghost images by multiple developing rollers and (ii) ghost images by a single developing roller, which are described above.

For the latter type of ghost image, the position of the ghost image can be determined based on the outer diameter of the developing roller and the development θ.

For example, when the outer diameter is 25 mm and the development θ is 1.8, the occurrence cycle of the ghost image is 25π/1.8=43 mm. Accordingly, the ghost image emerges 43 mm away from the leading end of the solid image CTa.

Figure 11:
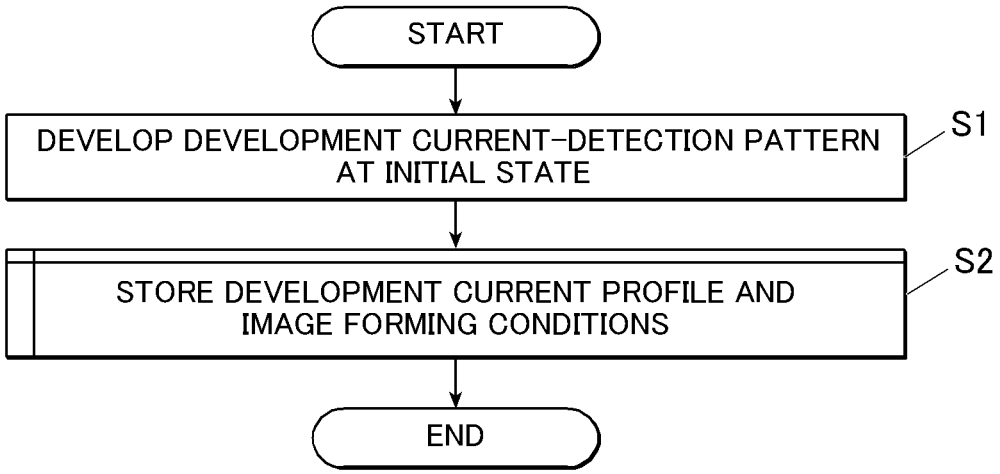
FIG. 11 is a flowchart at the initial setting.
Figure 12:
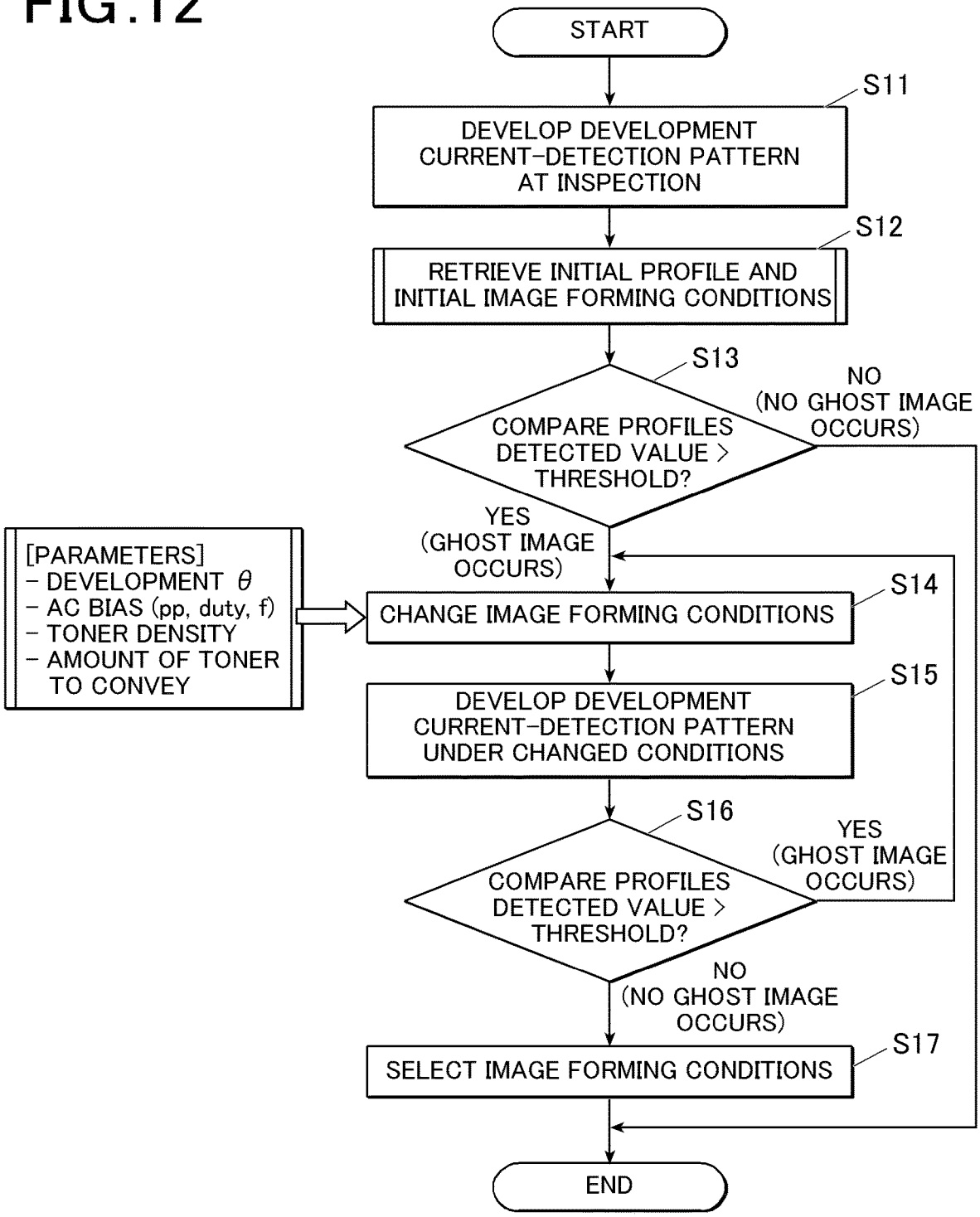
FIG. 12 is a flowchart at an inspection.

On the basis of above, a procedure of detecting ghost images and changing image forming conditions to avoid ghost images is described with reference to flowcharts shown in FIGS. 11, 12.

At the initial and normal state of the image forming apparatus 1, the controller 100 develops the development current-detection pattern CT (S1). Under predetermined image forming conditions, the controller 100 causes the exposing device 411 to draw the development current-detection pattern CT on the photoconductive drum 413 in the image-conveying direction of the photoconductive drum 413 and cause the developing device 412 to develop the development current-detection pattern CT.

The controller 100 obtains, from the development current detector 409, information on chronological changes of the detected values of the development current (i.e., development current profile) and stores the information along with the applied image forming conditions (S2).

At a periodical or necessary inspection of the image forming apparatus 1 after certain operation hours, the controller 100 develops the development current-detection pattern CT (S11) Similar to S1, under the predetermined image forming conditions, the controller 100 causes the exposing device 411 to draw the development current-detection pattern CT on the photoconductive drum 413 in the image-conveying direction of the photoconductive drum 413 and cause the developing device 412 to develop the development current-detection pattern CT.

The controller 100 obtains, from the development current detector 409, information on chronological changes of the detected values of the development current (i.e., development current profile) and retrieves the initial development current profile and the initial image forming conditions stored in S2 (S12). The controller 100 compares the development current profile of the latest inspection and the initial development current profile. By comparing these development current profiles, the controller 100 detects how much the development current decreases at the negative ghost CTg part. The controller 100 then determines whether or not the detected value (level of decrease) exceeds a predetermined threshold to determine whether or not the negative ghost CTg part is a ghost image originated from the solid image CTa (S13). When the detected value (level of decrease) exceeds the predetermined threshold, the controller 100 determines that a ghost image is present.

When determining that no ghost image is present (S13: NO), the controller 100 determines that there is no problem and ends the process. The controller 100 continues to use the image forming conditions used in S11.

In S1 and S11, the controller 100 uses the image forming conditions under which the upstream first developing roller 412*a* and the downstream second developing roller 412*b* receive the same development bias. When receiving different development biases, the developing rollers have different electric potentials, which allow current to flow. Applying the same development bias to the developing rollers allows the development current detector 409 to accurately detect the development current.

When determining that a ghost image is present (S13: YES), the controller 100 changes the image forming conditions (S14). Under the changed image forming conditions, the controller 100 develops the development current-detection pattern CT (S15). More specifically, under the changed image forming conditions, the controller 100 causes the exposing device 411 to draw the development current-detection pattern CT on the photoconductive drum 413 in the image-conveying direction of the photoconductive drum 413 and cause the developing device 412 to develop the development current-detection pattern CT.

The controller 100 also obtains, from the development current detector 409, information on chronological changes of the detected values of the development current (i.e., development current profile) and compares the development current profile under the changed image forming conditions and the initial development current profile. By comparing these development current profiles, the controller 100 detects how much the development current decreases at the negative ghost CTg part. The controller 100 then determines whether or not the detected value (level of decrease) exceeds a predetermined threshold to determine whether or not the negative ghost CTg part is a ghost image originated from the solid image CTa (S16). When the detected value (level of decrease) exceeds the predetermined threshold, the controller 100 determines that a ghost image is present.

When determining that a ghost image is present (S16: YES), the controller 100 further changes the image forming conditions and repeats the process of S14 to S16.

When determining that no ghost image is present (S16: NO), the controller 100 selects the image forming conditions under which a ghost image does not occur (S17) and ends the process. The controller 100 operates the image forming apparatus 1 under the selected image forming conditions.

Change of the image forming conditions in S14 may be done as follows.

The image forming conditions to be changed in S14 include development bias (alterative current peak-to-peak voltage (ACpp), duty cycle), development frequency f (frequency of the development bias), toner density, amount of toner to be conveyed, development θ, and distance between the photoconductive drum 413 and the developing rollers 412*a*, 412*b*.

Following measures may be taken when a ghost image is caused by multiple developing rollers.

One measure is to increase the development θ. Increasing the development θ may yield a development current profile in which ghost images are reduced.

As another measure, changing the development bias (ACpp, duty cycle) and/or the development frequency f may yield a development current profile in which ghost images are reduced.

As another measure, increasing the toner density may yield a development current profile in which ghost images are reduced.

As another measure, increasing the amount of developer to be conveyed may yield a development current profile in which ghost images are reduced.

As another measure, widening the distance between the photoconductive drum 413 and the upstream first developing roller 412*a* may yield a development current profile in which ghost images are reduced.

Following measures may be taken when a ghost image is caused by a single developing roller.

One measure is to decrease the ACpp of the development bias.

Another measures is to increase the duty cycle of the development bias.

Another measure is to decrease the development θ.

Another measure is to widen the distance between the photoconductive drum 413 and the upstream first developing roller 412*a*.

Another measure is to reduce the amount of developer to be conveyed.

These measures may yield a development current profile in which ghost images are reduced.

Two or more among the above parameters may be changed.

As described above, the position where a ghost image occurs depends on the development θ. The development θ is therefore usable in identifying a ghost image.

More specifically, in S11 and/or S14, the controller 100 uses different image forming conditions including different developments θ to obtain their respective development current profiles. The controller 100 then compares these development current profiles. When determining that the different developments θ result in different partial drops between these development current profiles, the controller 100 determines that a ghost image is present. When determining that the position of the temporal drop of the profile is not different between these development current profiles or determining that the position of the temporal drop of the profile is different but not due to the different developments θ, the controller 100 determines that no ghost image is present. Accordingly, accuracy in identifying a ghost image can be increased.

According to the embodiment described above, a ghost image can be identified easily and reduced by changing image forming conditions.

The scope of the present invention is not limited to the embodiment described above but can be variously modified within the scope of the present invention. The scope of the present invention should be interpreted by terms of the appended claims

What is claimed is:

1. An image forming apparatus comprising:

an image carrier;

an exposing device that draws an electrostatic latent image on the image carrier;

a developing device that supplies, using a developing roller facing the image carrier, a developer to the electrostatic latent image formed on the image carrier to form a toner image;

a development current detector that detects development current that flows between the image carrier and the developing roller; and a hardware processor that controls the image carrier, the exposing device, the developing device, and the development current detector, wherein under a predetermined image forming condition, the hardware processor causes the exposing device to draw a development current-detection pattern on the image carrier, the development current-detection pattern including a solid image and a halftone image that follows the solid image in an image-conveying direction of the image carrier, causes the developing device to develop the development current-detection pattern, obtains, from the development current detector, information on a chronological change of the detected development current, and determines whether or not a ghost image due to the solid image occurs based on a temporary drop of the detected development current during development of the halftone image, wherein the image forming condition includes a ratio of a linear velocity of the developing roller to a linear velocity of the image carrier, and the hardware processor uses different image forming conditions that include different ratios, each of the image forming conditions being the image forming condition, each of the ratios being the ratio, and in response to determining that the different ratios result in different temporary drops of the detected development current, determines that the ghost image occurs.

2. The image forming apparatus of claim 1, wherein the developing device:

includes an upstream developing roller and a downstream developing roller each of which is the developing roller and which are arranged in the image-conveying direction of the image carrier, adjusts a thickness of the developer with the upstream developing roller and delivers the developer to the downstream developing roller, and develops the electrostatic latent image formed on the image carrier with a time lag between the upstream developing roller and the downstream developing roller.

3. The image forming apparatus according to claim 2, wherein the upstream developing roller and the downstream developing roller receive an identical development bias in developing the development current-detection pattern.

4. The image forming apparatus according to claim 2, wherein in response to determining that the ghost image occurs, the hardware processor changes the image forming condition.

5. The image forming apparatus according to claim 4, wherein in changing the image forming condition, the hardware processor changes at least one among a development bias, a frequency of the development bias, a toner density, an amount of toner to be conveyed, a ratio of a linear velocity of the developing roller to a linear velocity of the image carrier, and a distance between the image carrier and the developing roller.

* * * * *